US009656125B2

(12) United States Patent
Nakamura

(10) Patent No.: US 9,656,125 B2
(45) Date of Patent: May 23, 2017

(54) GOLF BALL

(75) Inventor: Hirotaka Nakamura, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 1100 days.

(21) Appl. No.: 13/479,326

(22) Filed: May 24, 2012

(65) Prior Publication Data

US 2013/0005509 A1 Jan. 3, 2013

(30) Foreign Application Priority Data

Jun. 29, 2011 (JP) ..... 2011-143656

(51) Int. Cl.
*A63B 37/12* (2006.01)
*A63B 37/00* (2006.01)

(52) U.S. Cl.
CPC ..... *A63B 37/0004* (2013.01); *A63B 37/002* (2013.01); *A63B 37/0016* (2013.01); *A63B 37/0017* (2013.01); *A63B 37/0018* (2013.01); *A63B 37/0021* (2013.01)

(58) Field of Classification Search
CPC ..... A63B 37/0016; A63B 37/0017
USPC ..... 473/383–385
See application file for complete search history.

(56) References Cited

U.S. PATENT DOCUMENTS

| | | | | |
|---|---|---|---|---|
| 4,813,677 | A | 3/1989 | Oka et al. | |
| 4,979,747 | A | 12/1990 | Jonkouski | |
| 5,016,887 | A | 5/1991 | Jonkouski | |
| 5,033,750 | A | 7/1991 | Yamagishi et al. | |
| 5,158,300 | A | 10/1992 | Aoyama | |
| 5,902,193 | A | 5/1999 | Shimosaka et al. | |
| 2005/0107189 | A1 | 5/2005 | Ohama et al. | |
| 2007/0142129 | A1 * | 6/2007 | Kasashima et al. | 473/383 |

FOREIGN PATENT DOCUMENTS

| | | | |
|---|---|---|---|
| JP | 4-371170 | A | 12/1992 |
| JP | 10-99468 | A | 4/1998 |
| JP | 2005-143877 | A | 6/2005 |

* cited by examiner

*Primary Examiner* — Raeann Gorden
(74) *Attorney, Agent, or Firm* — Birch, Stewart, Kolasch & Birch, LLP

(57) ABSTRACT

A golf ball 2 has, on a surface thereof, a plurality of types of dimples 8 having different diameters from each other. A standard deviation Vσ of the volumes of all the dimples 8 is equal to or less than 0.095 $mm^3$. The ratio (Vσ/Dσ) of the standard deviation Vσ to a standard deviation Dσ of the diameters of all the dimples 8 is equal to or less than 0.35. Preferably, the shape of each dimple 8 is a portion of a spherical surface. The standard deviation Vσ is preferably equal to or less than 0.087 $mm^3$. The ratio (Vσ/Dσ) is preferably equal to or less than 0.29.

7 Claims, 8 Drawing Sheets

GOLF BALL

This application claims priority on Patent Application No. 2011-143656 filed in JAPAN on Jun. 29, 2011. The entire contents of this Japanese Patent Application are hereby incorporated by reference.

BACKGROUND OF THE INVENTION

Field of the Invention

The present invention relates to golf balls. Specifically, the present invention relates to improvement of dimples of golf balls.

Description of the Related Art

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

The degree of turbulization depends on a dimple pattern. In a golf ball in which the ratio of the total area of dimples to the surface area of a phantom sphere of the golf ball is high, the degree of turbulization is great. The golf ball in which this ratio is high has excellent flight performance.

It is known that the degree of turbulization is great in a golf ball in which the diameters of dimples are less varied. The golf ball has excellent flight performance.

In order to increase the ratio of the total area of dimples, it is necessary to locate a small-diameter dimple in a narrow zone surrounded by a plurality of dimples. The presence of the small-diameter dimple causes an increase in variation of the diameters of dimples. Increasing this ratio and suppressing the variation of the diameters are incompatible with each other.

The degree of turbulization also depends on the cross-sectional shapes of dimples. In a golf ball in which dimples are too deep, turbulization is insufficient. Also in a golf ball in which dimples are too shallow, turbulization is insufficient.

There have been various proposals for the cross-sectional shapes of dimples. JPS62-192181 (U.S. Pat. No. 4,813,677) discloses a golf ball that has dimples having large diameters and large depths and dimples having small diameters and small depths.

JPH2-134175 (U.S. Pat. No. 5,033,750) discloses a golf ball in which the difference between a value obtained by dividing the diameter of a dimple by the depth thereof and a value obtained by dividing the diameter of another dimple by the depth thereof is equal to or less than 0.3.

JPH3-198875 (U.S. Pat. No. 4,979,747) discloses a golf ball that has dimples having large diameters and small depths and dimples having small diameters and large depths.

JPH4-231079 (U.S. Pat. No. 5,016,887) discloses a golf ball in which values obtained by dividing the depths of all dimples by the diameters thereof are the same.

JPH4-371170 discloses a golf ball in which the shapes of all dimples are the same.

JPH5-237202 (U.S. Pat. No. 5,158,300) discloses a golf ball in which the edge angles of all dimples are the same.

The greatest interest to golf players concerning golf balls is flight distance. In light of flight performance, there is room for improvement in dimples. An object of the present invention is to provide a golf ball having excellent flight performance.

SUMMARY OF THE INVENTION

A golf ball according to the present invention has, on a surface thereof, a plurality of types of dimples, each of the types having different diameters from the other types. A standard deviation $V\sigma$ of volumes of all the dimples is equal to or less than 0.095 $mm^3$. A ratio ($V\sigma/D\sigma$) of the standard deviation $V\sigma$ to a standard deviation $D\sigma$ of diameters of all the dimples is equal to or less than 0.35.

In the golf ball according to the present invention, the volumes of the dimples are less varied. According to the finding by the inventor of the present invention, in the golf ball in which the volumes of the dimples are less varied, the degree of turbulization is great even when the diameters of the dimples are greatly varied. The golf ball has excellent flight performance. In the golf ball, the ratio ($V\sigma/D\sigma$) is equal to or less than 0.35. In other words, the volumes of the dimples are less varied and the diameters of the dimples are greatly varied. The golf ball has a high degree of freedom in designing a dimple pattern. Therefore, a desired dimple occupation ratio can easily be obtained.

Preferably, a shape of each dimple is a portion of a spherical surface.

Preferably, the standard deviation $V\sigma$ is equal to or less than 0.087 $mm^3$. Preferably, the ratio ($V\sigma/D\sigma$) is equal to or less than 0.29.

Preferably, a sum of the volumes of all the dimples is equal to or greater than 270 $mm^3$ but equal to or less than 340 $mm^3$. Preferably, the sum is equal to or greater than 280 $mm^3$ but equal to or less than 330 $mm^3$.

Preferably, a ratio of a sum of areas of all the dimples to a surface area of a phantom sphere of the golf ball is equal to or greater than 75% but equal to or less than 95%. Preferably, the ratio is equal to or greater than 80% but equal to or less than 95%.

Preferably, a number of types of the dimples is equal to or greater than 4. Preferably, a total number of the dimples is equal to or greater than 240 but equal to or less than 400.

DESCRIPTION OF THE PREFERRED EMBODIMENTS

The following will describe in detail the present invention, based on preferred embodiments with reference to the accompanying drawings.

Figure 1:
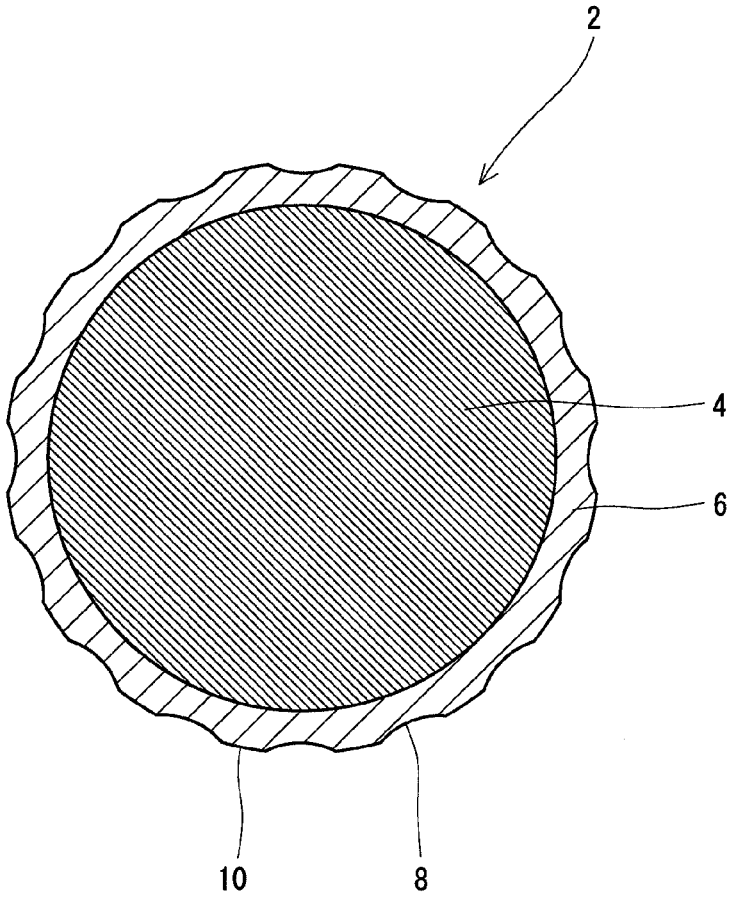
FIG. 1 is a cross-sectional view of a golf ball according to one embodiment of the present invention.

A golf ball 2 shown in FIG. 1 includes a spherical core 4 and a cover 6. On the surface of the cover 6, a large number of dimples 8 are formed. Of the surface of the golf ball 2, a part other than the dimples 8 is a land 10. The golf ball 2 includes a paint layer and a mark layer on the external side of the cover 6 although these layers are not shown in the drawing. A mid layer may be provided between the core 4 and the cover 6.

The golf ball 2 has a diameter of preferably 40 mm or greater but 45 mm or less. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 has a weight of preferably 40 g or greater but 50 g or less. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of base rubbers for use in the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferred, and high-cis polybutadienes are particularly preferred.

In order to crosslink the core 4, a co-crosslinking agent is suitably used. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

According to need, various additives such as a filler, sulfur, a vulcanization accelerator, a sulfur compound, an anti-aging agent, a coloring agent, a plasticizer, a dispersant, and the like are included in the rubber composition of the core 4 in an adequate amount. Synthetic resin powder or crosslinked rubber powder may also be included in the rubber composition.

The core 4 has a diameter of preferably 30.0 mm or greater and particularly preferably 38.0 mm or greater. The diameter of core 4 is preferably equal to or less than 42.0 mm and particularly preferably equal to or less than 41.5 mm. The core 4 may be composed of two or more layers. The core 4 may have a rib on the surface thereof. The core 4 may be hollow.

A suitable polymer for the cover 6 is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, other polymers may be used for the cover 6. Examples of the other polymers include polyurethanes, polystyrenes, polyamides, polyesters, and polyolefins. In light of spin performance and scuff resistance, polyurethanes are preferred. Two or more polymers may be used in combinations.

According to need, a coloring agent such as titanium dioxide and a fluorescent pigment, a filler such as barium sulfate, a dispersant, an antioxidant, an ultraviolet absorber, a light stabilizer, a fluorescent material, a fluorescent brightener, and the like are included in the cover 6 in an adequate amount. For the purpose of adjusting specific gravity, powder of a metal having a high specific gravity such as tungsten and molybdenum may be included in the cover 6.

The cover 6 has a thickness of preferably 0.2 mm or greater and particularly preferably 0.3 mm or greater. The thickness of the cover 6 is preferably equal to or less than 2.5 mm and particularly preferably equal to or less than 2.2 mm. The cover 6 has a specific gravity of preferably 0.90 or greater and particularly preferably 0.95 or greater. The specific gravity of the cover 6 is preferably equal to or less than 1.10 and particularly preferably equal to or less than 1.05. The cover 6 may be composed of two or more layers.

Figure 2:
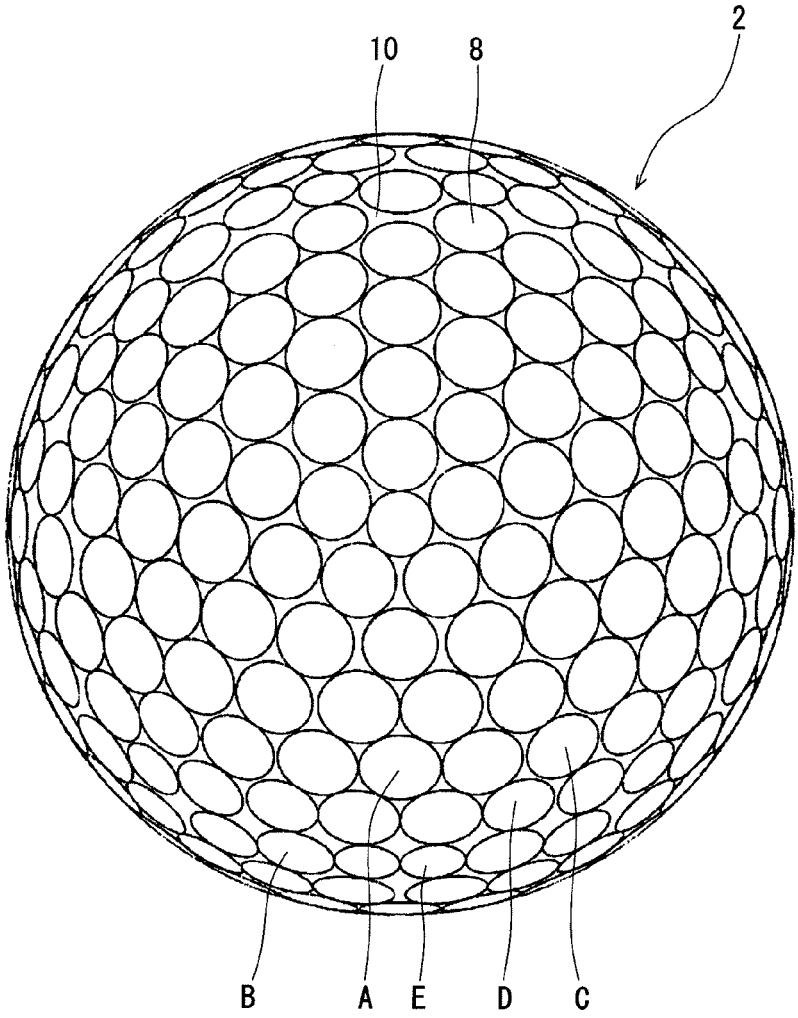
FIG. 2 is an enlarged plan view of the golf ball in FIG. 1.
Figure 3:
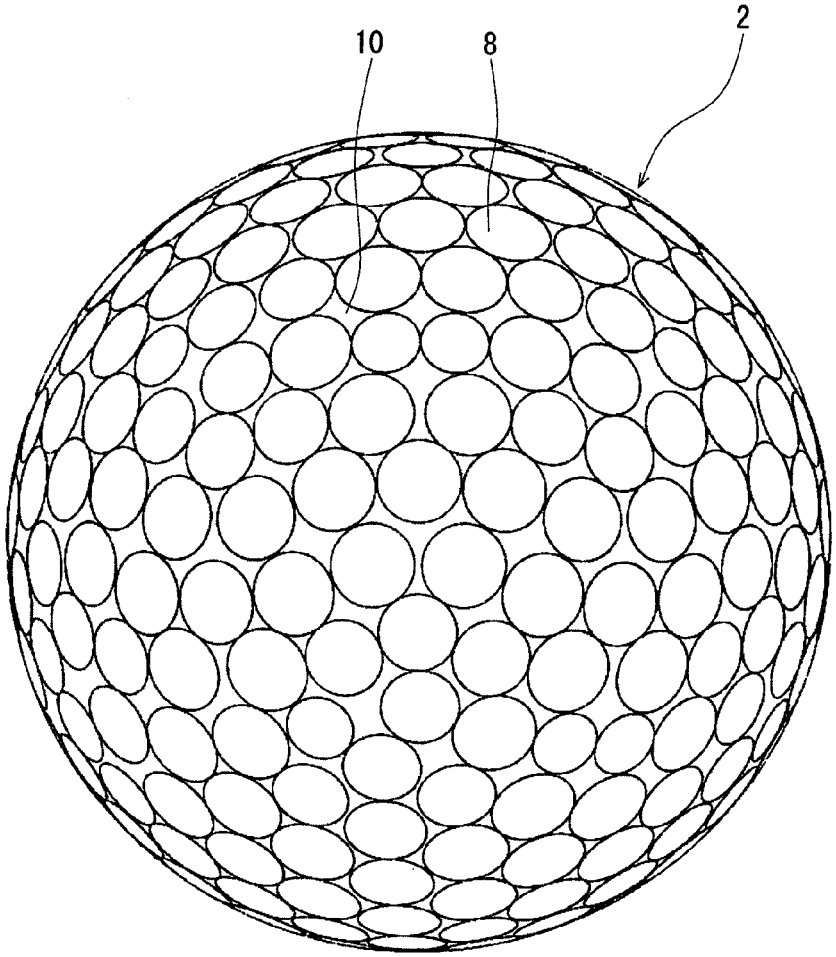
FIG. 3 is a front view of the golf ball in FIG. 2.

As shown in FIGS. 2 and 3, the contour of each dimple 8 is circular. The golf ball 2 has dimples A each having a diameter of 4.50 mm; dimples B each having a diameter of 4.40 mm; dimples C each having a diameter of 4.30 mm; dimples D each having a diameter of 4.10 mm; and dimples E each having a diameter of 3.60 mm. The number of types of the dimples 8 is five.

The number of the dimples A is 108; the number of the dimples B is 78; the number of the dimples C is 20; the number of the dimples D is 100; and the number of the dimples E is 18. The total number of the dimples 8 is 324.

Figure 4:
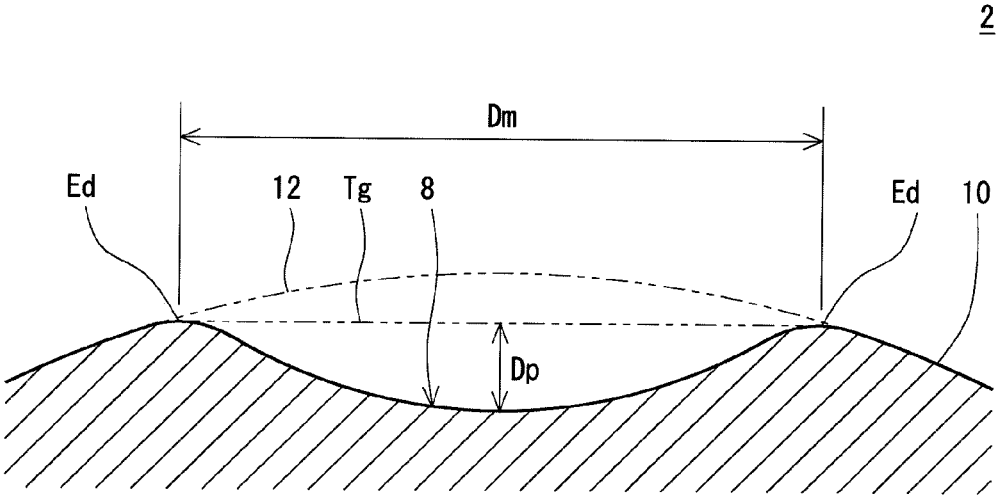
FIG. 4 is a partially enlarged cross-sectional view of the golf ball in FIG. 1.

FIG. 4 shows a cross section along a plane passing through the center of the dimple 8 and the center of the golf ball 2. In FIG. 4, the top-to-bottom direction is the depth direction of the dimple 8. In FIG. 4, what is indicated by a chain double-dashed line 12 is the surface of a phantom sphere. The surface of the phantom sphere 12 is the surface of the golf ball 2 when it is postulated that no dimple 8 exists. The dimple 8 is recessed from the surface of the phantom sphere 12. The land 10 agrees with the surface of the phantom sphere 12. In the present embodiment, the cross-sectional shape of each dimple 8 is substantially a circular arc.

In FIG. 4, what is indicated by a double ended arrow Dm is the diameter of the dimple 8. The diameter Dm is the distance between two tangent points Ed appearing on a tangent line Tg that is drawn tangent to the far opposite ends of the dimple 8. Each tangent point Ed is also the edge of the dimple 8. The edge Ed defines the contour of the dimple 8. In FIG. 4, what is indicated by a double ended arrow Dp is the depth of the dimple 8. The depth Dp is the distance between the tangent line Tg and the deepest part of the dimple 8.

In the present invention, the term "volume" of dimple means the volume of a part surrounded by the surface of the dimple 8 and a plane that includes the edge of the dimple 8. In the present embodiment, the volume of each dimple A is 0.833 $mm^3$; the volume of each dimple B is 0.833 $mm^3$; the volume of each dimple C is 0.833 $mm^3$; the volume of each dimple D is 0.833 $mm^3$; and the volume of each dimple E is 0.833 $mm^3$. In other words, the volumes of all the dimples 8 are substantially the same. Due to processing errors of the golf ball 2 and measurement errors of the dimple shape, the volume of each dimple 8 may be slightly different from 0.833 $mm^3$. Such a state is referred to as "substantially the same" in the present invention.

The golf ball 2 may have dimples having volumes different from each other. In such a case, a golf ball in which the dimple volumes are less varied is preferred. According to the finding by the inventor of the present invention, in the golf ball 2 in which the dimple volumes are less varied, the degree of turbulization is great. The golf ball 2 has excellent flight performance. Even when the dimple volumes are less varied, the diameter Dm of each dimple type can arbitrarily be determined. Therefore, the dimples 8 can densely be arranged. The synergistic effect of the less variation of the dimple volumes and the high density of the dimples 8 achieves excellent flight performance. Preferably, the volumes of all the dimples 8 are substantially the same.

A standard deviation Vσ of the volumes of all the dimples 8 is preferably equal to or less than 0.095 $mm^3$. In the golf ball 2 in which the standard deviation Vσ is equal to or less than 0.095 $mm^3$, the degree of turbulization is great. In light of turbulization, the standard deviation Vσ is more preferably equal to or less than 0.087 $mm^3$ and particularly preferably equal to or less than 0.068 $mm^3$. Ideally, the standard deviation Vσ is zero.

The detailed reason why the golf ball 2 in which the dimple volumes are less varied has excellent flight performance has not been identified. It is inferred that the fact that the phenomenon caused by backspin regularly occurs near separation points prompts turbulization.

In a first method for determining the standard deviation Vσ, the cross-sectional shapes of all the dimples 8 are measured. The volumes of all the dimples 8 are calculated on the basis of the cross-sectional shapes. The standard deviation Vσ is calculated on the basis of these volumes.

Instead of the first method, a second method may conveniently be used. In the second method, first, the average volume Av is calculated on the basis of the following mathematical formula.

$$Av=(Va*108+Vb*78+Vc*20+Vd*100+Ve*18)/324$$

In this mathematical formula, Va is the volume of the dimple A; Vb is the volume of the dimple B; Vc is the volume of the dimple C; Vd is the volume of the dimple D; and Ve is the volume of the dimple E. Va is calculated by measuring the cross-sectional shapes of a plurality of dimples A that are randomly sampled. Vb is calculated by measuring the cross-sectional shapes of a plurality of dimples B that are randomly sampled. Vc is calculated by measuring the cross-sectional shapes of a plurality of dimples C that are randomly sampled. Vd is calculated by measuring the cross-sectional shapes of a plurality of dimples D that are randomly sampled. Ve is calculated by measuring the cross-sectional shapes of a plurality of dimples E that are randomly sampled. The number of the sampled dimples per dimple type is equal to or greater than 4 but equal to or less than 6.

In the second method, the standard deviation Vσ is calculated on the basis of the following mathematical formula.

$$V\sigma=(((Va-Av)^2*108+(Vb-Av)^2*78+(Vc-Av)^2*20+(Vd-Av)^2*100+(Ve-Av)^2*18)/(324-1))^{1/2}$$

The ratio (Vσ/Dσ) of the standard deviation Vσ of the volumes to a standard deviation Dσ of the diameters of all the dimples 8 is equal to or less than 0.35. In the golf ball 2 in which the ratio (Vσ/Dσ) is equal to or less than 0.35, the dimple volumes are less varied and the diameters Dm are greatly varied. In the golf ball 2 in which the diameters Dm are greatly varied, the dimples 8 can densely be arranged. The synergistic effect of the less variation of the dimple volumes and the high dimple density achieves excellent flight performance. In this respect, the ratio (Vσ/Dσ) is more preferably equal to or less than 0.29 and particularly preferably equal to or less than 0.24.

As described above, the golf ball 2 has the five types of the dimples 8 having different diameters from each other. From the standpoint that the dimples 8 can densely be arranged, the number of the types of the dimples 8 is preferably equal to or greater than 2, more preferably equal to or greater than 4, and particularly preferably equal to or greater than 5.

As described above, the cross-sectional shape of each dimple 8 is substantially a circular arc. In other words, the shape of each dimple 8 is a portion of a spherical surface. The type of the dimple 8 is referred to as a single radius type. At the dimple 8, air flows on the surface of the golf ball 2 without remaining thereon.

As is obvious from FIG. 4, the dimple 8 may have an outwardly convex curved surface near the edge Ed. The cross-sectional shape of the dimple 8 is not a perfect circular arc. In a zone that is 90% or greater of the surface area of the dimple 8, the cross-sectional shape is preferably an inwardly convex arc.

The diameter Dm of each dimple 8 is preferably equal to or greater than 2.0 mm but equal to or less than 6.0 mm. The dimple 8 having a diameter Dm of 2.0 mm or greater contributes to turbulization. In this respect, the diameter Dm is more preferably equal to or greater than 2.4 mm and particularly preferably equal to or greater than 2.8 mm. In the golf ball 2 in which the diameter Dm is equal to or less than 6.0 mm, a fundamental feature of the golf ball 2 being substantially a sphere is not impaired. In this respect, the diameter Dm is more preferably equal to or less than 5.6 mm and particularly preferably equal to or less than 5.2 mm.

The average diameter Ad of the dimples 8 is preferably equal to or greater than 3.9 mm but equal to or less than 4.5 mm. In the golf ball 2 in which the average diameter Ad is in this range, the degree of turbulization is great. The golf ball 2 has excellent flight performance. The average diameter Ad is particularly preferably equal to or greater than 4.0 mm. The average diameter Ad is particularly preferably equal to or less than 4.4 mm.

The area s of the dimple 8 is the area of a region surrounded by the contour line when the center of the golf ball 2 is viewed at infinity. In the case of a circular dimple 8, the area s is calculated by the following mathematical formula.

$$s=(Dm/2)^2*\Pi$$

In the golf ball 2 shown in FIGS. 2 and 3, the area of each dimple A is 15.90 $mm^2$; the area of each dimple B is 15.21 $mm^2$; the area of each dimple C is 14.52 $mm^2$; the area of each dimple D is 13.20 $mm^2$; and the area of each dimple E is 10.18 $mm^2$.

The ratio of the sum of the areas s of all the dimples 8 to the surface area of the phantom sphere 12 is referred to as an occupation ratio. In light of turbulization, the occupation ratio is preferably equal to or greater than 75%, more preferably equal to or greater than 80%, and particularly preferably equal to or greater than 81.9%. The occupation ratio is preferably equal to or less than 95%. In the golf ball 2 shown in FIGS. 2 and 3, the total area of all the dimples 8 is 4697.2 $mm^2$. The surface area of the phantom sphere 12 of the golf ball 2 is 5741.5 $mm^2$, and thus the occupation ratio is 81.9%.

In light of suppression of rising of the golf ball 2 during flight, the total volume of all the dimples 8 is preferably equal to or greater than 250 $mm^3$, more preferably equal to or greater than 270 $mm^3$, and particularly preferably equal to or greater than 280 $mm^3$. In light of suppression of dropping of the golf ball 2 during flight, the total volume is preferably equal to or less than 380 $mm^3$, more preferably equal to or less than 340 $mm^3$, and particularly preferably equal to or less than 330 $mm^3$.

From the standpoint that each dimple 8 can contribute to turbulization, the depth Dp is preferably equal to or greater than 0.05 mm, more preferably equal to or greater than 0.06 mm, and particularly preferably equal to or greater than 0.07 mm. In light of suppression of dropping of the golf ball 2 during flight, the depth Dp is preferably equal to or less than 0.26 mm, more preferably equal to or less than 0.24 mm, and particularly preferably equal to or less than 0.22 mm.

In light of turbulization, the total number of the dimples 8 is preferably equal to or greater than 240 and particularly preferably equal to or greater than 270. From the standpoint that each dimple 8 can contribute to turbulization, the total number is preferably equal to or less than 450, more preferably equal to or less than 400, and particularly preferably equal to or less than 350.

EXAMPLES

Example 1

A rubber composition was obtained by kneading 100 parts by weight of a polybutadiene (trade name "BR-730", manufactured by JSR Corporation), 30 parts by weight of zinc diacrylate, 6 parts by weight of zinc oxide, 10 parts by weight of barium sulfate, 0.5 parts by weight of diphenyl disulfide, and 0.5 parts by weight of dicumyl peroxide. This rubber composition was placed into a mold including upper and lower mold halves each having a hemispherical cavity, and heated at 170° C. for 18 minutes to obtain a core with a diameter of 39.75 mm. A resin composition was obtained by kneading 50 parts by weight of an ionomer resin (trade name "Himilan 1605", manufactured by Du Pont-MITSUI POLYCHEMICALS Co., Ltd.), 50 parts by weight of another ionomer resin (trade name "Himilan 1706", manufactured by Du Pont-MITSUI POLYCHEMICALS Co., Ltd.), and 3 parts by weight of titanium dioxide. The above core was placed into a final mold having a large number of pimples on its inside face, and the above resin composition was injected around the core by injection molding to form a cover with a thickness of 1.5 mm. Dimples having a shape that is the inverted shape of the pimples were formed on the cover. A clear paint including a two-component curing type polyurethane as a base material was applied to this cover to obtain a golf ball of Example 1 with a diameter of 42.75 mm and a weight of about 45.4 g. The golf ball has a PGA compression of about 85. The golf ball has a dimple pattern shown in FIGS. 2 and 3. The detailed specifications of the dimples are shown in Table 1 below.

Examples 2 to 9 and Comparative Examples 1 to 3

Golf balls of Examples 2 to 9 and Comparative Examples 1 to 3 were obtained in the same method as Example 1, except the final mold was changed. The detailed specifications of the dimples are shown in Tables 1 to 3 below.

TABLE 1

| Specifications of Dimples | | | | | |
|---|---|---|---|---|---|
| | Type | Number of dimples | Diameter (mm) | Depth (mm) | Volume ($mm^3$) |
| Example 2 | A | 108 | 4.50 | 0.1046 | 0.833 |
| | B | 78 | 4.40 | 0.1094 | 0.833 |
| | C | 20 | 4.30 | 0.1145 | 0.833 |
| | D | 100 | 4.10 | 0.1260 | 0.833 |
| | E | 18 | 3.60 | 0.1632 | 0.833 |
| Example 3 | A | 108 | 4.50 | 0.1086 | 0.865 |
| | B | 78 | 4.40 | 0.1136 | 0.865 |
| | C | 20 | 4.30 | 0.1190 | 0.865 |
| | D | 100 | 4.10 | 0.1308 | 0.865 |
| | E | 18 | 3.60 | 0.1693 | 0.865 |
| Example 1 | A | 108 | 4.50 | 0.1182 | 0.941 |
| | B | 78 | 4.40 | 0.1236 | 0.941 |
| | C | 20 | 4.30 | 0.1294 | 0.941 |
| | D | 100 | 4.10 | 0.1422 | 0.941 |
| | E | 18 | 3.60 | 0.1841 | 0.941 |
| Example 4 | A | 108 | 4.50 | 0.1277 | 1.017 |
| | B | 78 | 4.40 | 0.1335 | 1.017 |
| | C | 20 | 4.30 | 0.1398 | 1.017 |
| | D | 100 | 4.10 | 0.1537 | 1.017 |
| | E | 18 | 3.60 | 0.1990 | 1.017 |
| Example 5 | A | 108 | 4.50 | 0.1313 | 1.046 |
| | B | 78 | 4.40 | 0.1374 | 1.046 |
| | C | 20 | 4.30 | 0.1438 | 1.046 |
| | D | 100 | 4.10 | 0.1580 | 1.046 |
| | E | 18 | 3.60 | 0.2045 | 1.046 |

TABLE 2

| Specifications of Dimples | | | | | |
|---|---|---|---|---|---|
| | Type | Number of dimples | Diameter (mm) | Depth (mm) | Volume ($mm^3$) |
| Example 6 | A | 108 | 4.50 | 0.1202 | 0.957 |
| | B | 78 | 4.40 | 0.1257 | 0.957 |
| | C | 20 | 4.30 | 0.1316 | 0.957 |
| | D | 100 | 4.10 | 0.1447 | 0.957 |
| | E | 18 | 3.60 | 0.1296 | 0.661 |
| Compara. Example 1 | A | 108 | 4.50 | 0.1296 | 1.032 |
| | B | 78 | 4.40 | 0.1296 | 0.987 |
| | C | 20 | 4.30 | 0.1296 | 0.943 |
| | D | 100 | 4.10 | 0.1296 | 0.857 |
| | E | 18 | 3.60 | 0.1296 | 0.661 |
| Compara. Example 2 | A | 108 | 4.50 | 0.1350 | 1.075 |
| | B | 78 | 4.40 | 0.1320 | 1.005 |
| | C | 20 | 4.30 | 0.1290 | 0.938 |
| | D | 100 | 4.10 | 0.1230 | 0.813 |
| | E | 18 | 3.60 | 0.1080 | 0.551 |

TABLE 3

| Specifications of Dimples | | | | | |
|---|---|---|---|---|---|
| | Type | Number of dimples | Diameter (mm) | Depth (mm) | Volume ($mm^3$) |
| Example 7 | A | 132 | 4.70 | 0.1090 | 0.947 |
| | B | 18 | 4.50 | 0.1189 | 0.947 |
| | C | 28 | 4.40 | 0.1244 | 0.947 |
| | D | 54 | 4.30 | 0.1302 | 0.947 |
| | E | 68 | 4.10 | 0.1432 | 0.947 |
| | F | 6 | 3.60 | 0.1854 | 0.947 |
| | G | 16 | 3.30 | 0.2200 | 0.947 |
| Example | A | 132 | 4.70 | 0.1117 | 0.970 |

TABLE 3-continued

| Specifications of Dimples | | | | | |
|---|---|---|---|---|---|
| | Type | Number of dimples | Diameter (mm) | Depth (mm) | Volume ($mm^3$) |
| 8 | B | 18 | 4.50 | 0.1218 | 0.970 |
| | C | 28 | 4.40 | 0.1274 | 0.970 |
| | D | 54 | 4.30 | 0.1333 | 0.970 |
| | E | 68 | 4.10 | 0.1466 | 0.970 |
| | F | 6 | 3.60 | 0.1400 | 0.714 |
| | G | 16 | 3.30 | 0.1400 | 0.600 |
| Compara. Example 3 | A | 132 | 4.70 | 0.1247 | 1.083 |
| | B | 18 | 4.50 | 0.1247 | 0.993 |
| | C | 28 | 4.40 | 0.1247 | 0.950 |
| | D | 54 | 4.30 | 0.1247 | 0.907 |
| | E | 68 | 4.10 | 0.1247 | 0.825 |
| | F | 6 | 3.60 | 0.1247 | 0.636 |
| | G | 16 | 3.30 | 0.1247 | 0.535 |
| Example 9 | A | 20 | 4.40 | 0.1038 | 0.790 |
| | B | 160 | 4.05 | 0.1225 | 0.790 |
| | C | 200 | 3.90 | 0.1320 | 0.790 |
| | D | 12 | 2.90 | 0.1260 | 0.417 |
| Compara. Example 4 | A | 20 | 4.40 | 0.1260 | 0.959 |
| | B | 160 | 4.05 | 0.1260 | 0.813 |
| | C | 200 | 3.90 | 0.1260 | 0.754 |
| | D | 12 | 2.90 | 0.1260 | 0.417 |

[Flight Distance Test]

A driver with a titanium head (trade name "XXIO", manufactured by SRI Sports Limited, shaft hardness: S, loft angle: 10.0°) was attached to a swing machine manufactured by True Temper Co. A golf ball was hit under the condition of a head speed of 45 m/sec, and the distance from the launch point to the stop point was measured. At the test, the weather was almost windless. The average value of data obtained by 10 measurements is shown in Tables 4 to 6 below.

TABLE 4

| Results of Evaluation | | | | | |
|---|---|---|---|---|---|
| | Ex. 2 | Ex. 3 | Ex. 1 | Ex. 4 | Ex. 5 |
| Plan view | FIG. 2 | FIG. 2 | FIG. 2 | FIG. 2 | FIG. 2 |
| Front view | FIG. 3 | FIG. 3 | FIG. 3 | FIG. 3 | FIG. 3 |
| Total dimple number | 324 | 324 | 324 | 324 | 324 |
| Average diameter Ad (mm) | 4.29 | 4.29 | 4.29 | 4.29 | 4.29 |
| Dσ | 0.235 | 0.235 | 0.235 | 0.235 | 0.235 |
| Average volume Av ($mm^3$) | 0.833 | 0.865 | 0.941 | 1.017 | 1.046 |
| Vσ | 0.000 | 0.000 | 0.000 | 0.000 | 0.000 |
| Vσ/Dσ | 0.00 | 0.00 | 0.00 | 0.00 | 0.00 |
| Total volume ($mm^3$) | 270 | 280 | 305 | 329 | 339 |
| Occupation ratio (%) | 81.9 | 81.9 | 81.9 | 81.9 | 81.9 |
| Flight distance (m) | 256.0 | 257.0 | 257.5 | 257.0 | 255.5 |

TABLE 5

| Results of Evaluation | | | |
|---|---|---|---|
| | Ex. 6 | Comp. Ex. 1 | Comp. Ex. 2 |
| Plan view | FIG. 2 | FIG. 2 | FIG. 2 |
| Front view | FIG. 3 | FIG. 3 | FIG. 3 |
| Total dimple number | 324 | 324 | 324 |
| Average diameter Ad (mm) | 4.29 | 4.29 | 4.29 |
| Dσ | 0.235 | 0.235 | 0.235 |
| Average volume Av ($mm^3$) | 0.941 | 0.941 | 0.940 |
| Vσ | 0.068 | 0.099 | 0.143 |
| Vσ/Dσ | 0.29 | 0.42 | 0.61 |

TABLE 5-continued

| Results of Evaluation | | | |
|---|---|---|---|
| | Ex. 6 | Comp. Ex. 1 | Comp. Ex. 2 |
| Total volume ($mm^3$) | 305 | 305 | 305 |
| Occupation ratio (%) | 81.9 | 81.9 | 81.9 |
| Flight distance (m) | 256.5 | 253.0 | 251.5 |

TABLE 6

Figure 5:
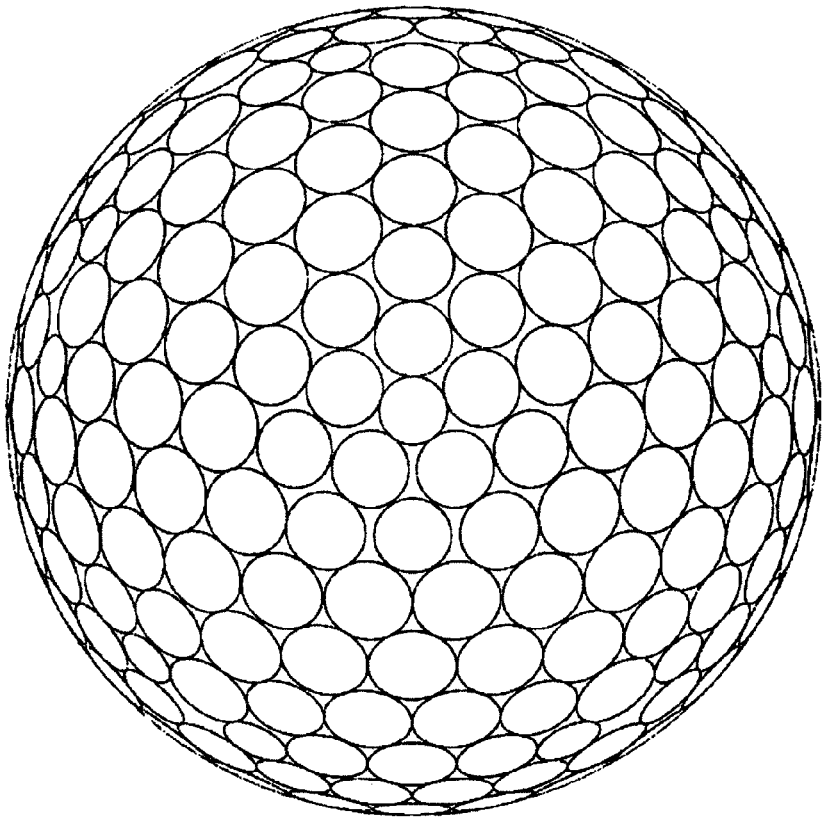
FIG. 5 is a plan view of a golf ball according to Example 7 of the present invention.
Figure 6:
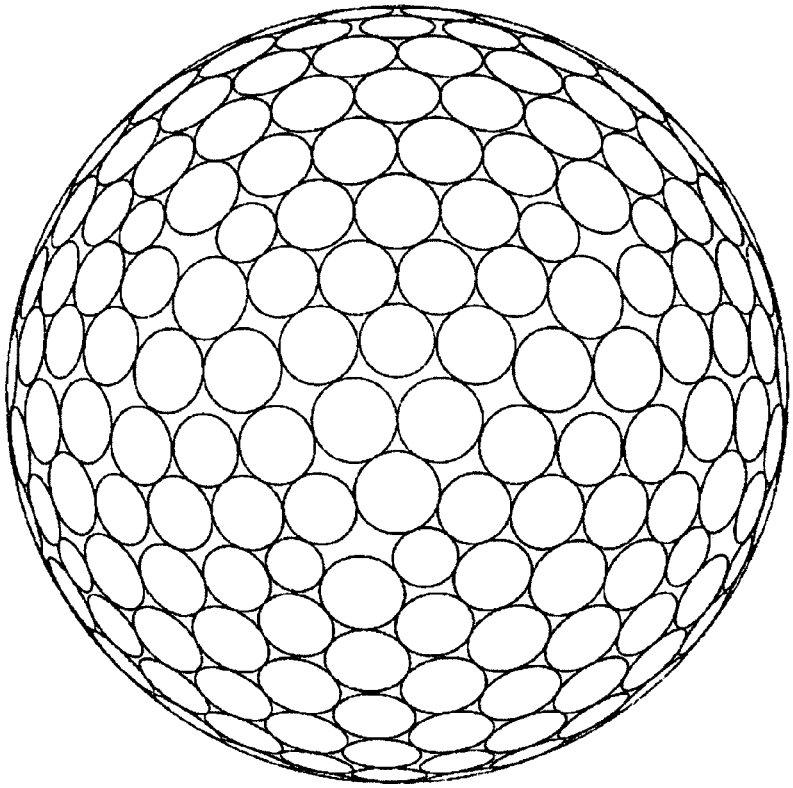
FIG. 6 is a front view of the golf ball in FIG. 5.
Figure 7:
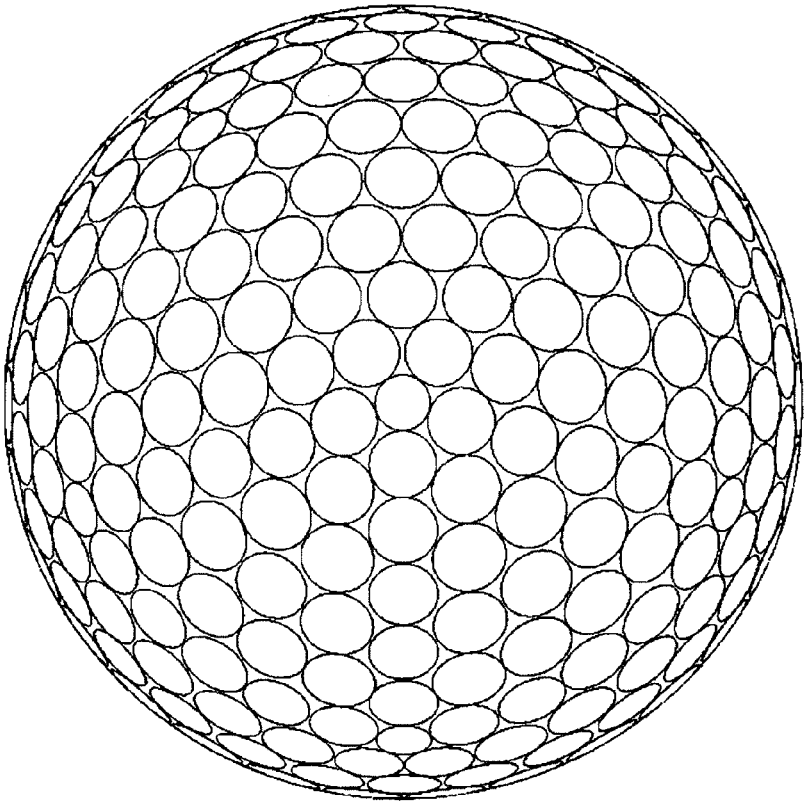
FIG. 7 is a plan view of a golf ball according to Example 9 of the present invention.
Figure 8:
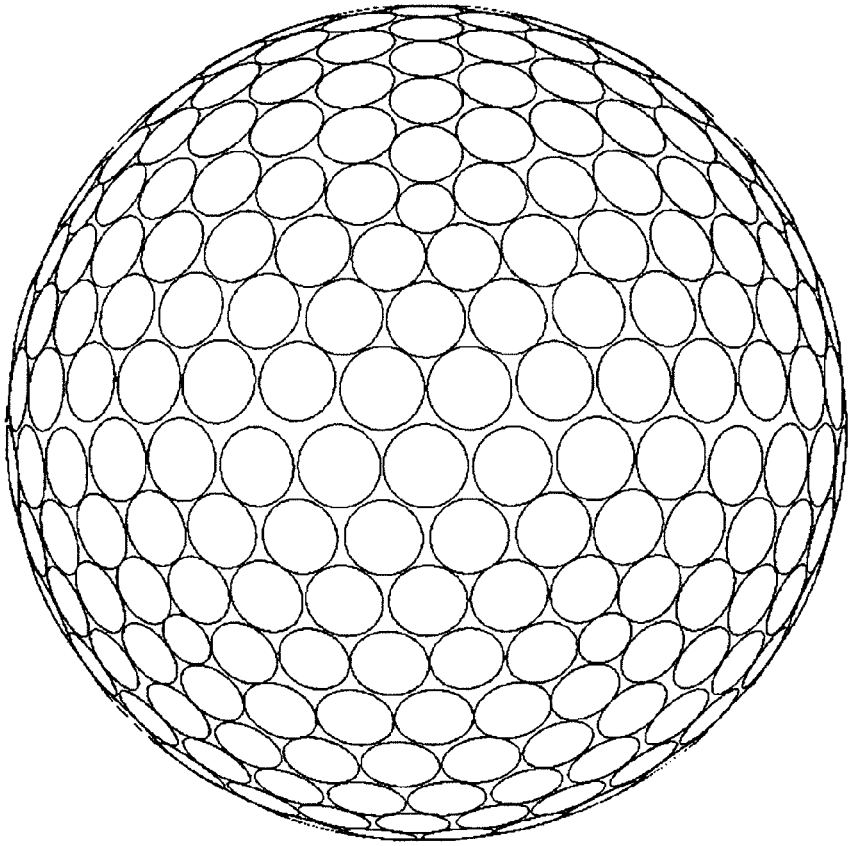
FIG. 8 is a front view of the golf ball in FIG. 7.

| Results of Evaluation | | | | | |
|---|---|---|---|---|---|
| | Ex. 7 | Ex. 8 | Comp. Ex. 3 | Ex. 9 | Comp. Ex. 4 |
| Plan view | FIG. 5 | FIG. 5 | FIG. 5 | FIG. 7 | FIG. 7 |
| Front view | FIG. 6 | FIG. 6 | FIG. 6 | FIG. 8 | FIG. 8 |
| Total dimple number | 322 | 322 | 322 | 392 | 392 |
| Average diameter Ad (mm) | 4.38 | 4.38 | 4.38 | 3.96 | 3.96 |
| Dσ | 0.361 | 0.361 | 0.361 | 0.223 | 0.223 |
| Average volume Av ($mm^3$) | 0.947 | 0.947 | 0.947 | 0.778 | 0.778 |
| Vσ | 0.000 | 0.087 | 0.147 | 0.064 | 0.080 |
| Vσ/Dσ | 0.00 | 0.24 | 0.41 | 0.29 | 0.36 |
| Total volume ($mm^3$) | 305 | 305 | 305 | 305 | 305 |
| Occupation ratio (%) | 85.1 | 85.1 | 85.1 | 84.2 | 84.2 |
| Flight distance (m) | 258.5 | 257.0 | 253.5 | 257.0 | 254.0 |

As shown in Tables 4 to 6, the golf ball of each Example has excellent flight performance. From the results of evaluation, advantages of the present invention are clear.

The aforementioned dimples are applicable to a one-piece golf ball, a multi-piece golf ball, and a thread-wound golf ball, in addition to a two-piece golf ball. The above descriptions are merely for illustrative examples, and various modifications can be made without departing from the principles of the present invention.

What is claimed is:

1. A golf ball having, on a surface thereof, a plurality of types of dimples, each of the types having different diameters from the other types, wherein a total volume of all said dimples ranges from 280 $mm^3$ to 340 $mm^3$, a standard deviation Vσ of volumes of all the dimples is equal to or less than 0.095 $mm^3$, a depth of each dimple ranges from 0.07 mm to 0.22 mm, a ratio (Vσ/Dσ) of the standard deviation Vσ to a standard deviation Dσ of diameters of all the dimples is equal to or less than 0.35, a total number of the dimples ranges from 270 to 350, and a ratio of a sum of areas of all the dimples to a surface area of a phantom sphere of the golf ball is equal to or greater than 75% but equal to or less than 95%.

2. The golf ball according to claim 1, wherein a shape of each dimple is a portion of a spherical surface.

3. The golf ball according to claim 1, wherein the standard deviation Vσ is equal to or less than 0.087 $mm^3$.

4. The golf ball according to claim 1, wherein the ratio (Vσ/Dσ) is equal to or less than 0.29.

5. The golf ball according to claim 1, wherein the sum of the volumes of all the dimples is equal to or greater than 280 $mm^3$ but equal to or less than 330 $mm^3$.

6. The golf ball according to claim 1, wherein the ratio of the areas of all the dimples is equal to or greater than 80% but equal to or less than 95%.

7. The golf ball according to claim 1, wherein a number of types of the dimples is equal to or greater than 4.

* * * * *